52-169.9
10/15/85 CR 4,546,581

United States Patent [19]

Gustafson

[11] Patent Number: 4,546,581

[45] Date of Patent: Oct. 15, 1985

[54] BUILDING STRUCTURE SUPPORT SYSTEM

[76] Inventor: Harold L. Gustafson, 11316 NE. 189th St., Battle Ground, Wash. 98604

[21] Appl. No.: 640,152

[22] Filed: Aug. 10, 1984

[51] Int. Cl.[4] ..... E02D 27/48

[52] U.S. Cl. ..... 52/169.9; 52/126.6; 52/262; 52/23

[58] Field of Search ..... 52/169.9, 23, DIG. 11, 52/262, 126.6; 248/188.4, 357, 354.3

[56] References Cited

U.S. PATENT DOCUMENTS

| | | | |
|---|---|---|---|
| 3,616,584 | 11/1971 | Sartori et al. | 52/126.6 |
| 3,742,662 | 7/1973 | Ballou | 248/188.4 |
| 4,234,151 | 11/1980 | John et al. | 248/354.3 |
| 4,261,149 | 4/1981 | Gustafson | 52/DIG. 11 |
| 4,404,780 | 9/1983 | Josephson | 248/357 |
| 4,417,426 | 11/1983 | Meng | 52/169.9 |

*Primary Examiner*—Lenard A. Footland
*Attorney, Agent, or Firm*—Daniel J. Meaney, Jr.

[57] ABSTRACT

A support system for a building structure having a foundation formed of a plurality of spaced, parallel support beams wherein each support member includes a planar base having a vertically extending support member which is threaded around its periphery, an elongated thrust member wherein the center thereof is formed into a hollowed-out central area having its interior wall thereof threaded to coact in response to rotation between the vertically extending support member and the elongated thrust member has at least two protruding members extending from the rim thereof, a bottom member having a vertically extending portion which is adapted to receive the elongated thrust member mounted on the vertically extending support member and wherein the bottom member has a pair of aligned base tabs positioned adjacent the planar base, an elongated sleeve member which is adapted to be inserted into the vertically extending portion of the bottom member and wherein the elongated sleeve has two slots which are adapted to receive the two protruding members on the elongated thrust member and a top member having a top stabilizing plate and an extended lower portion which is adapted to receive the other end of the sleeve member and wherein the top member includes gripping means adapted to be affixedly attached to one of the beams as shown.

23 Claims, 20 Drawing Figures

FIG. 1
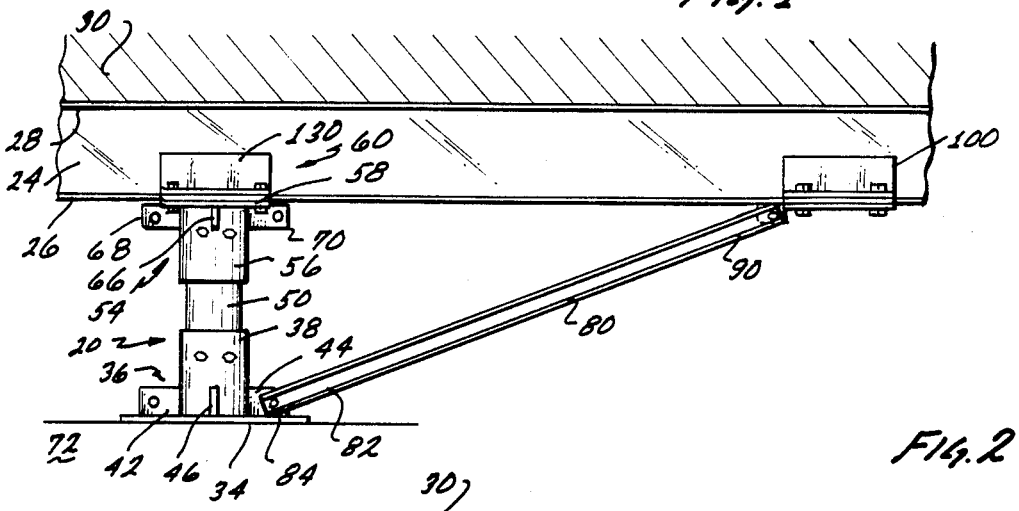
FIG. 2
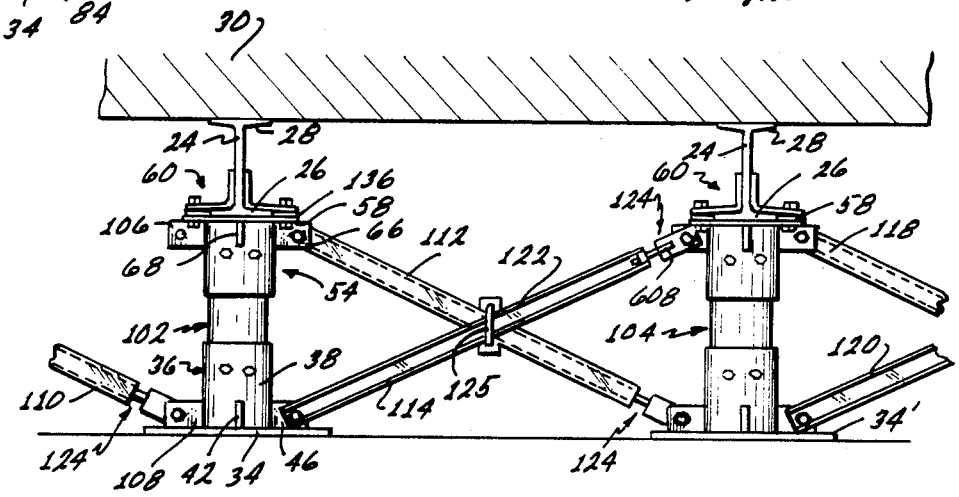
FIG. 4
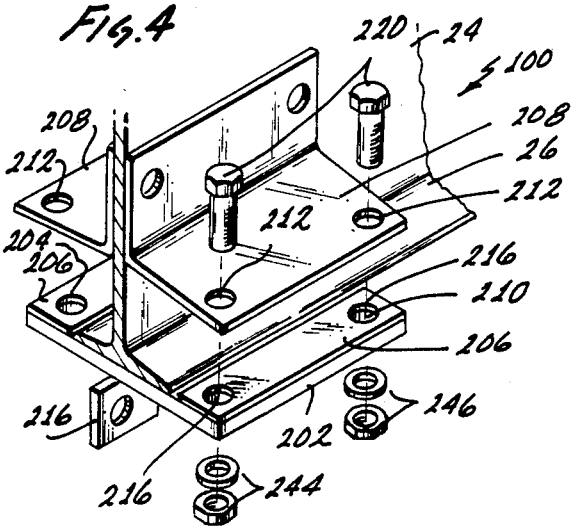
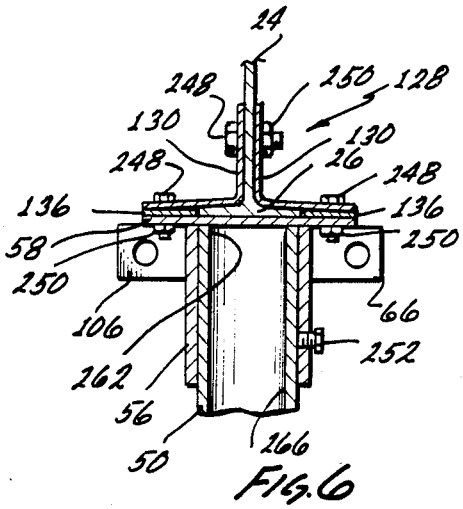
FIG. 6

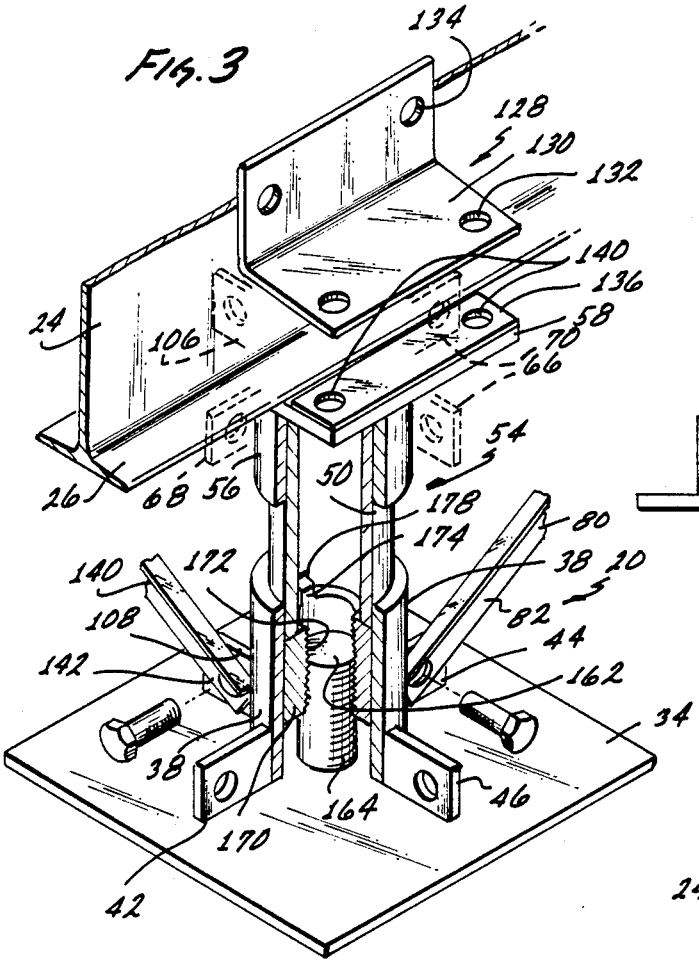
Fig. 3
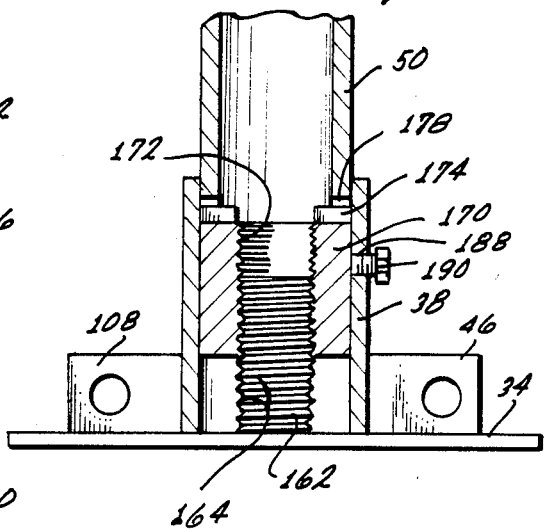
Fig. 5
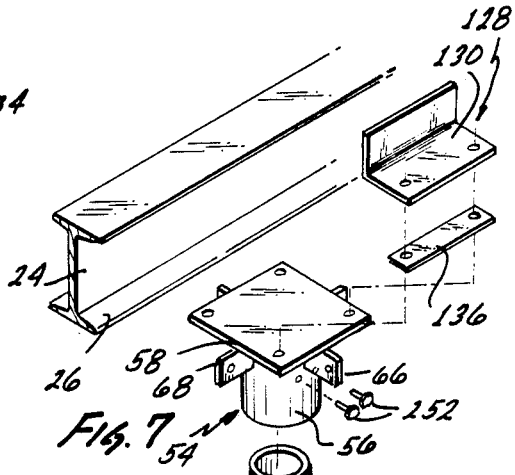
Fig. 7
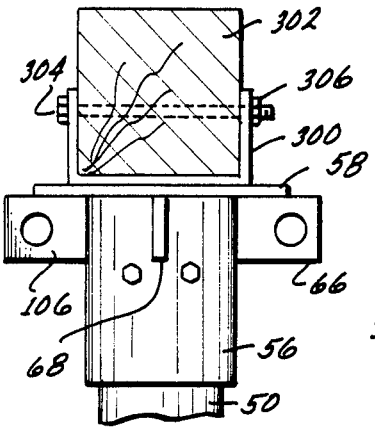
Fig. 8
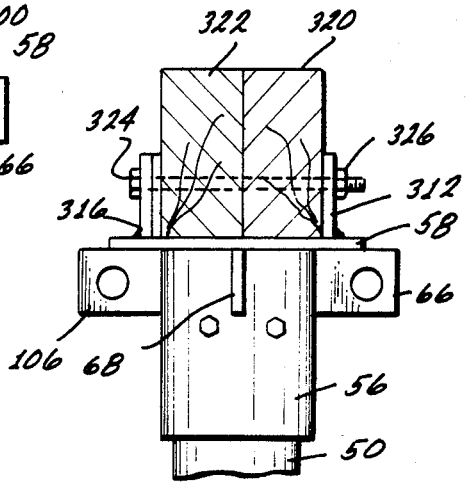
Fig. 9
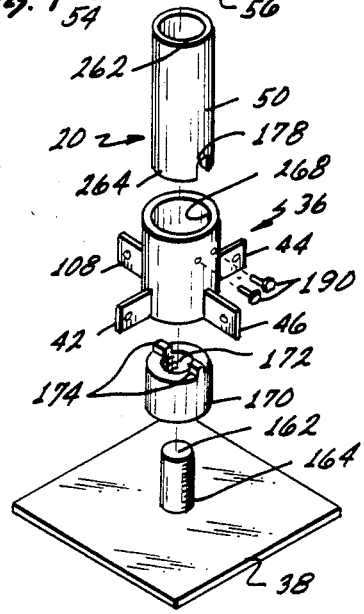

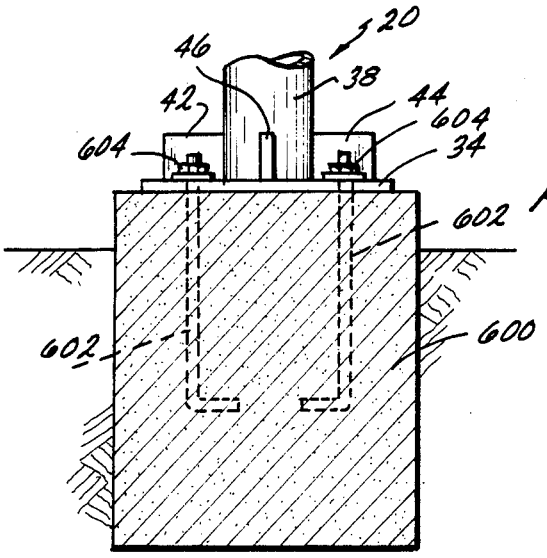
Fig. 17
Fig. 18
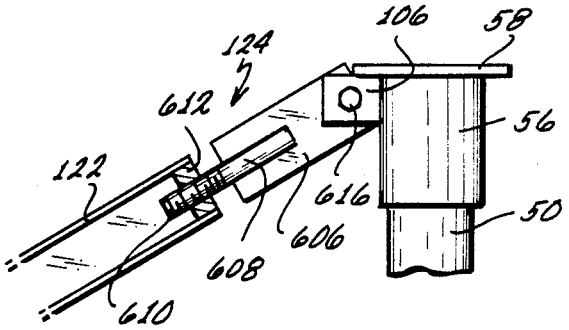
Fig. 19a
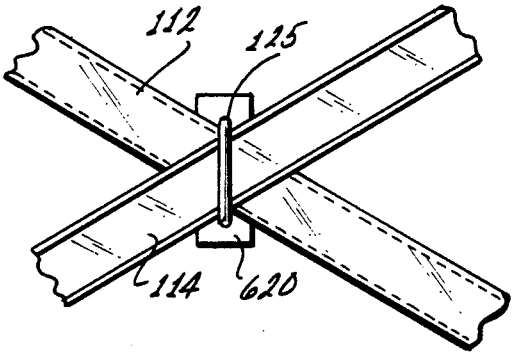
Fig. 19b
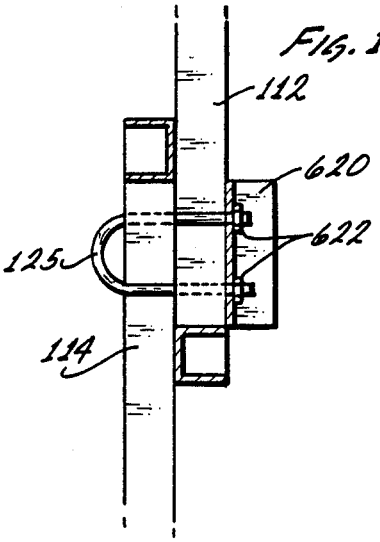

BUILDING STRUCTURE SUPPORT SYSTEM

BACKGROUND OF THE INVENTION

1. Field of the Invention

This invention relates to a support system for a building structure having the foundation formed of a plurality of spaced, parallel support beams and, more particularly, to a support structure having a plurality of support members wherein each support member comprises an assembly which includes a planar base with a vertically extending member which coacts with an elongated thrust member, a top member and a bottom member and a sleeve which is adapted to be inserted into the bottom and top member wherein the sleeve and an elongated thrust member are adapted to have a rotational force applied thereto to cause relative movement between the elongated thrust member and the vertically extending support member for varying the distance between the top member and the planar base to provide an adjustable support member which cooperates with the plurality of strut stabilizing rods to provide a rigid support system for the building structure. The support system is capable of supporting a building structure during earthquake or other similar jarring forces.

2. Disclosure of the Prior Art

It is known in the art to provide a support system for a building structure such as a mobile home, manufactured home, permanent building structure or the like. One such support system is disclosed in U.S. Pat. No. 4,261,149, wherein the patentee is the same inventor, which comprises a mobile home support system for a mobile home having a chassis formed of a plurality of spaced, parallel support beams wherein the support beams have an I-shaped cross section wherein the support system comprises a plurality of support member assemblies. Each of the support member assemblies disclosed in U.S. Pat. No. 4,261,149 includes a planar base, a vertically extending portion having a predetermined external dimension and shape, aligned base tabs which extend from the vertically extending support member, a top member having a vertically extending lower portion, and an adjustment ring adapted to be located between the sleeve and the vertically extending lower portion of the top member and the planar base. The adjustment ring has an internal dimension and shape to enable the ring to be slidably positioned circumferentially around the exterior of the vertically extending portion of the base wherein the wall thickness of the ring is about equal to the distance between the vertically extending portion the base and tab member and a top member which has an extended lower portion formed to an internal geometrical dimension which is shaped to receive and slide over the vertically extending portion of the base and into contact with the edge of the ring. The adjustable ring is selected to have an axial length which is required to position the vertically extending lower portion of the top member at the appropriate space required to secure the desired spacing between the planar base and a top stabilizing plate. Thus, the teaching is that an internal adjustment ring or its equivalent is utilized to obtain the desired spacing between the top member and the planar base member in a support system. U.S. Pat. No. 4,261,149 also discloses that the top member includes a stabilizing plate and a gripping means which is adapted to attach the stabilizing plate to a flange of the "I" beams. The top member further includes a pair of aligned top tabs which are positioned on each side of the extended lower portion of the top member in substantially the same position in alignment with the base tabs. A plurality of strut stabilizing rods having one end which extends from the top tabs and the bottom tabs to another support assembly or a strut stabilizing rod connecting device clamped to the same "I" beam was disclosed.

U.S. Pat. No. 4,417,426 disclosed a support system for structures such as mobile homes, trailers and the like. In the preferred embodiment, the support system comprises two main support members each having two legs supported by a base with a clamping means at the top thereof. The height of the legs is adjustable by means of bolts which extend upwardly from the base, there being two nuts on the bolts to support the two legs. The support system includes two cross-braces which interconnect for further support of the two main support members as well as a stabilizer for providing support on a plane perpendicular to the plane of the cross-braces. FIG. 6 of, U.S. Pat. No. 4,417,426 disclosed a variation of a foundation support structure wherein each support member comprises a top member and a bottom member, each of which are threaded in opposite directions, and a cylindrical leg which likewise is threaded at each end thereof and adapted to cooperate with the threaded top member and bottom member. The cylindrical leg is responsive to rotation about its longitudinal axis in one direction to cause the threaded ends of the cylindrical leg to screw further out of both the lower member and the top member. The result of such a rotation is to increase the effective height of the support member. Rotation of the cylindrical leg in the opposite direction causes the threads at each end of the cylindrical leg to screw further into the lower member and top member, thereby reducing the effective height of the support member 72. In addition, the support illustrated in FIG. 6 of U.S. Pat. No. 4,417,426 disclosed the use of L-shaped angle members which are adapted to be operatively connected between the top member and a beam to be supported by the support structure.

SUMMARY OF THE INVENTION

The present invention discloses an improved support system for a building structure having a foundation formed of a plurality of spaced, parallel support beams and, more specifically, a support member which is adapted for use therewith. In the preferred embodiment, the support member includes a planar base which has a vertically extending support member of a selected length and a predetermined external dimension and shape. The vertically extending support member includes a first coacting means located around the periphery thereof. In the preferred embodiment, the vertically extending support member is threaded. The support member further includes an elongated thrust member which has a selected axial length and a selected external geometrical dimension. The elongated thrust member includes means for defining a hollowed-out central area which extends axially therethrough forming a rim of a selected thickness at each end thereof. The hollowed-out central area defining means includes means for forming an interior wall having a second coacting means located thereon which is capable of coacting with the first coacting means in response to a rotational force applied therebetween to produce relative movement therebetween. In the preferred embodiment, the second coacting means is likewise a threaded member which is adapted to coact with the threaded member on the vertically extending support member. The hollowed-out area has a cross-sectional dimension and shape which is adapted to receive and pass the vertically extending support member. The elongated thrust member further includes means for defining driving means, which in the preferred embodiment is at least two protruding members extending from one of the rims and in axial alignment with the hollowed-out central area. The elongated thrust member is positioned on the vertically extending support member with the rim thereof having the axially extending protruding members positioned remote from the elongated support member such that the first coacting means and the second coacting means coact with each other and are responsive to a rotational force applied therebetween to vary the distance between the elongated thrust member and the planar base. The support structure further includes a bottom member having a vertically extending portion formed of an internal geometrical dimension and shape to receive and slide over the elongated thrust member mounted on the vertically extending support member. The bottom member includes at least one pair of aligned base tabs positioned adjacent the planar base and one on each side of the vertically extending portion positioned adjacent the planar base. The elongated sleeve member has an elongated central opening which extends axially therethrough forming rims at each end thereof, and one of the rims includes driving means engagement means which is adapted to engage the driving means preferred embodiment, the driving means engagement means are a pair of slots. The elongated sleeve member has an internal geometrical dimension which is substantially equal to the selected external dimension of the vertically extending support member. The external geometrical dimension of the elongated sleeve member is of a shape and dimension to permit the one end of the sleeve member having the slot to be inserted into and transported through the vertically extending portion of the bottom member such that the rim thereof is brought into engagement with the rim of the elongated thrust member and such that the slot receives the protruding member. The support structure includes a top member which has a top stabilizing plate and an extended lower portion formed of an internal geometrical dimension and shape to receive and slide over the other end of the sleeve member. The other end of the sleeve member of the rim is adapted to slide within the extended lower portion of the top member and into engagement with the top stabilizing plate. The top member includes gripping means which is adapted to affixedly attached to the top stabilizing plate and to one of the beams. The top member has at least one pair of aligned top tabs positioned one on each side of the lower extended portion of the top and positioned in spaced, parallel alignment with at least one pair of base tabs.

The mobile home support system disclosed in U.S. Pat. No. 4,261,149 results in a support system which is integral with the chassis of the mobile home. In the event of an earthquake which results in a natural seismic wave, absent use of a mobile home support system disclosed in U.S. Pat. No. 4,261,149, relative movement normally would occur between the mobile home, the support system and the ground. However, in the support system disclosed in U.S. Pat. No. 4,261,149, the support system integral with the chassis of the mobile home moves relative to the ground due to the integral assembly of the mobile home and the mobile home support system.

In the support system disclosed in U.S. Pat. No. 4,261,149, the height or distance between the top member and the bottom member may be adjusted to a predetermined distance, and that adjustment is provided by means of an adjusting ring having an internal geometrical dimension and shape which is adapted to be positioned circumferentially around the exterior of the vertically extending portion. In order to vary the distance between the top and bottom member, it is necessary to have available a plurality of aligned adjusting rings or, in the alternative, to control the length of the lower extending portion of the top member and to cut the same to the exact desired length. Thus, the method of adjusting the distance between the top and bottom members requires precut components.

In the foundation support system as disclosed in FIG. 6 of U.S. Pat. No. 4,417,426, the distance between the top member and bottom member can be controllably varied or adjusted by rotating the center sleeve. Rotation of the center sleeve results in relative movement between the top member and the sleeve and the bottom member and the sleeve. The bottom member and the top member must be threaded in opposite directions and in a manner so as to coact with the threaded ends of the rotatable sleeve member. Thus, the support member disclosed in FIG. 6 of U.S. Pat. No. 4,417,426 requires threading of large-bore bottom members and large-bore top members and the threading of the large-bore sleeve member. The threads applied to each of the top member and bottom member must be in opposed directions in order to obtain the desired adjustable height of the support member under a building foundation.

One advantage of the present invention is that the building structure support system is adapted to form an integral unit with the building structure, and the distance required between the planar base and the top member which is brought into engagement with a beam forming the foundation of the building structure can be easily and precisely established such that the support system forms an integral unit with the building structure such that, during earth movements, any shifting and sliding results in relative movement occurring only between the support system, which is integral with the building structure, and earth.

Another advantage of the present invention is that a plurality of standard support member assemblies can be utilized as a foundation and support around the exterior of a building structure and a center support to allow for easier setup, installation or deinstallation of the building structure. The exact height required to support the building structure relative to the ground can be obtained by applying a rotational force between the sleeve member and the planar base, which rotational force is applied around the longitudinal axis of the elongated sleeve member, such that the exact height can be obtained by varying the distance along the axial length of the top member, the elongated sleeve member, and the bottom member.

A yet further advantage of the present invention is that the top member can be fabricated to accommodate either a standard single-wide mobile home, which typically has a dimension of about 12 feet to 16 feet in one direction and approximately 60 feet in the other direction, wherein the top member includes a gripping means which is adapted to rigidly grip a flange of an "I" beam utilized in the mobile home.

A yet further advantage of the present support system and support structure thereof is that the support system can be utilized with a standard double-wide mobile home, which typically has a dimension in one direction in the order of 26 to 28 feet and in the other direction in the order of 80 feet.

A still further advantage of the present invention is that the support member and support system utilizing the support member can be utilized for supporting a foundation for a manufactured home wherein the support beams are formed of either a large single beam or a laminated beam formed of a plurality of wood beams and wherein the top member includes a stabilizing plate and a gripping means which is adapted to be rigidly affixed to the beam supporting the foundation for the manufactured home.

A still yet further advantage of the present invention is that the support system and support member utilized therein can be used for a foundation of an existing residence or other building structure wherein the old pilings or foundation can be removed and replaced with a support system wherein the top stabilizing plate includes a gripping means which is adapted to be affixed to the support beams of the building structure foundation. The support beams may be either an "I" beam, a "J" beam, a wooden beam, or the like, any of which alone or in combination form the foundation of a residence or other building structure.

BRIEF DESCRIPTION OF THE DRAWING

These and other advantages of the present invention will become apparent when considered in light of the detailed description hereafter of the preferred embodiment, which includes the following figures:

FIG. 1 is a partial side view of a building structure illustrating one of the support members and the stabilizing struts extending from the support member to the support beam of a building structure;

FIG. 2 is a partial front view of a pair of support members installed under a "I" beam of a mobile home structure;

FIG. 3 is a perspective view in a partial cut-away illustrating a support member and gripping means of the present invention;

FIG. 4 is a perspective view of a strut stabilizing rod gripping means which is adapted to clamp to the bottom flange of a "I" beam of a building structure and to be connected to the end of a strut stabilizing rod;

FIG. 5 is a partial, cross-sectional front view illustrating the relationship between the various components which provides the adjusting capability of controlling the axial distance between the top member and the bottom member of a support structure;

FIG. 6 is a partial, front view, in cross section, illustrating one embodiment of the structure for forming the gripping means affixed to the top stabilizing plate;

FIG. 7 is a perspective exploded view of a support member attached to an "I" beam illustrating the components thereof;

FIG. 8 is a partial, cross-sectional front view illustrating the use of a U-shaped gripping member which is adapted to be utilized with a wooden beam on a building foundation;

FIG. 9 is a partial, cross-sectional front view of a stabilizing plate having a vertically extending flange affixed thereto which is adapted to receive and be affixed to a laminated support beam of a building structure;

FIG. 17 is a partial diagrammatic view of a footing having

FIG. 18 is a partial pictorial representation of an adjustable means to permit adjustment of a strut stabilizing rod relative to a support member; and FIGS. 19(*a*) and 19 (*b*) are a partial front view and a partial sectional view of two intersecting strut stabilizing rods clamped by a U-shaped bolt.

DESCRIPTION OF THE PREFERRED EMBODIMENT

Figure 10:
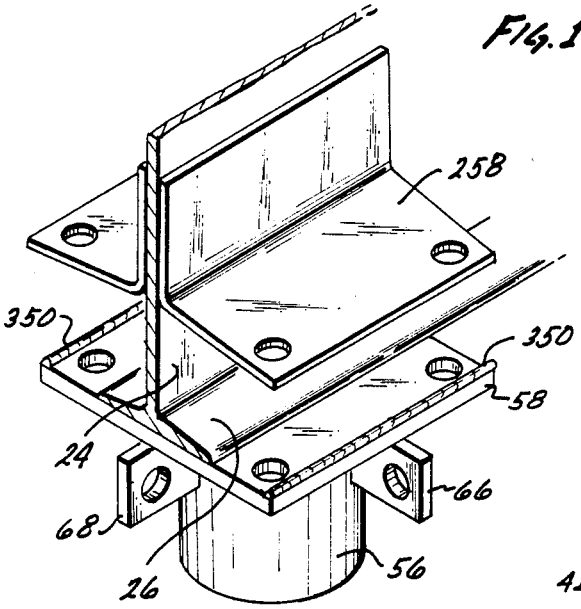
FIG. 10 is a partial perspective view showing another embodiment of a gripping means wherein the top stabilizing plate has a permanently affixed bead spacer attached thereto which cooperates with an L-shaped bracket to clamp against a flange of an "I" beam.

FIG. 1 illustrates that the support member of the present invention is adapted for use in a support system for a building structure having a foundation. In the preferred embodiment, the building structure has a foundation formed of a plurality of spaced, parallel support beams 24, wherein the support member, shown generally as 20, is adapted to be positioned under one of the beams 24, which beam is illustrated to be an "I" beam having a lower flange 26 and an upper flange 28. The "I" beam 24 is adapted to have the upper flange 28 in engagement with and/or secured to the foundation 30 of a building structure.

The support member 20 includes a planar base 34 having a vertically extending support member, shown as element 162 in FIG. 3, which is of a selected length and predetermined external dimension and shape. The selected length, predetermined external dimension and shape of element 162 will be further described in connection with FIG. 3. The vertically extending support member 162 includes a first coacting means located around the periphery thereof as illustrated in FIG. 3.

Referring again to FIG. 1, the support member 20 includes a bottom member 36 having a vertically extending portion 38 which is formed of an internal geometrical dimension which is adapted to receive and slide over an elongated thrust member illustrated as thrust member 170 in FIG. 3. The vertically extending portion 38 includes at least one pair of aligned base tabs 42 and 44. The preferred embodiment illustrated in FIG. 1 has an additional pair of opposed base tabs 46 and 108 (shown in FIG. 2) positioned adjacent the planar base 34 on the vertically extending portion 38. The pair of aligned base tabs 42 and 44 illustrated in FIG. 1 are positioned adjacent the planar base 34 and are located one on each side of the vertically extending portion 38 positioned adjacent the planar base 34. The other pair of base tabs 42 and 108 are likewise so positioned on the vertically extending portion 38 such that tabs 42, 44, 46 and 108 are spaced equidistantly thereabout.

An elongated sleeve member 50 is adapted to be located between the bottom member 36 and a top member 54. The details of the structural arrangement between the elongated sleeve member, the construction of the elongated sleeve member and the cooperation therebetween are illustrated in greater detail in FIGS. 3, 4 and 7.

In FIGS. 1 and 3, the top member, illustrated generally as element 54, has an extended lower portion 56 and a top stabilizing plate 58. The extended lower portion 56 of top member 54 is formed of an internal geometrical dimension and shape to receive and slide over the other end of the elongated sleeve member 50, permitting the rim of sleeve 50 to slide within the extended lower portion 38 and into engagement with the top stabilizing plate 58 as shown in FIG. 6. The top member 54 includes a gripping means, shown generally as 60, which is adapted to be affixedly attached to the top stabilizing plate 58 and to the "I" beam 24. The top stabilizing plate 58 has at least one pair of aligned top tabs 68 and 70, with top tabs 68 and 70 illustrated in FIG. 1. Also, an additional top tab 66 may be positioned on one side of the lower extended portion 56 of the top member 54 as shown in FIGS. 1 and 2. The aligned top tabs 68 and 70 are positioned in spaced, parallel alignment, with each other and with the pair of base tabs 42 and 44 located directly therebelow on the vertically extending portion 38 of base member 36.

In use, the distance between the top stabilizing plate 58 and the bottom base plate 34 is adjustable to control the height therebetween to position or adjust the foundation 30 to a predetermined distance from and essentially parallel to the ground 72. If desired, a concrete footing, such as that illustrated in FIG. 17, may be placed under the planar base 34.

In the embodiment illustrated in FIG. 1, the internal support system includes a strut stabilizing rod 80 which has one end extending from one of the selected bottom tabs. For example, 1 end 82 of strut stabilizing 80 is operatively coupled by a fastener 84 to the aligned base tab 44. It is necessary to have at least two strut stabilizing rods attached to a support member such as that illustrated in FIG. 2. This will be further discussed in connection with FIG. 2.

Strut stabilizing rod 80 illustrated in FIG. 1 has its other end 90 operatively coupled to a strut stabilizing rod gripping means 100 for affixedly connecting one end of the strut stabilizing rods 80, for example end 90, to the lower flange 26 of "I" beam 24. The details of the strut stabilizing rod connecting means 100 for operatively connecting the strut stabilizing rod 80 to the beam 24 are illustrated in greater detail in FIGS. 5 and 6.

In FIG. 2, the arrangement between two support members 102 and 104 is shown wherein support members 102 and 104 are located along a dimension which is equivalent to the width of a structure, such as, the width of a mobile home. The foundation 30 includes two parallel, spaced "I" beams, both of which are shown generally as 24. Each of the "I" beams has an upper flange 28, which is operatively connected to the foundation 30, and a lower flange 26, which is operatively coupled by a gripping means 60 to the top stabilizing plate 58 of each of the support members 102 and 104.

In FIG. 2, with respect to support member 102, the top member 54 includes a fourth aligned top tab 106 which is located in spaced alignment from the aligned top tab 66. The vertically extending portion 38 is illustrated to include a fourth aligned bottom tab 108 which is located in opposed, spaced relationship to tab 46. As illustrated in FIG. 2, the bottom aligned tab 106 is operatively coupled to one end of a strut stabilizing rod 110 which extends from an adjacent support member (not shown).

As illustrated in FIG. 2, the right side of support member 102 has two strut stabilizing rods 112 and 114 extending therefrom. Specifically, strut stabilizing rod 112 has one end thereof operatively connected by a fastening means to the aligned top tab 66 and is connected to the bottom tab of the adjacent support member 104 by an adjusting means 124 which is illustrated in greater detail in FIG. 18. In a similar manner, the bottom strut stabilizing rod 114 has one of its ends operatively connected by a fastening means to the aligned bottom tab 46 and to the top tab of the adjacent support member 104 through an adjusting means 124. In the embodiment illustrated in FIG. 2, the aligned top tab 66 and the aligned bottom tab 46 are located in substantially the same plane such that each of the strut stabilizing rods 112 and 114 extend therefrom in a substantially coplanar arrangement.

As illustrated in FIGS. 1 and 2, the strut stabilizing rod 80 (of FIG. 1) and strut stabilizing rods 110, 112, 114, 118, and 120 (of FIG. 2) are generally U-shaped or are formed of channel iron to provide structural support. As illustrated in FIG. 2, the strut stabilizing rods, which have a U-shaped cross section, are arranged such that the channels extending therefrom are positioned in opposed, spaced relationship so that they engage with each other at the point of crossing, shown generally as 122 in FIG. 2. A U-shaped clamp 125 is affixed to hold the strut stabilizing rods in a secure position. The details of the U-shaped clamp are illustrated in greater detail in FIGS. 19(*a*) and 19(*b*).

The structure, description and means for operatively connecting strut stabilizing rods 118 and 120 to the tabs are substantially identical to that described in connection with support member 102 of the same FIG. 2. Again, each of support members 102 and 104 are independently adjustable such that the distance between the top stabilizing plate 58 and the bottom planar base 34 is adjustable in the manner illustrated in FIGS. 3, 4 and 7 hereof. It is not necessary that the distance between each of the top stabilizing plate and the bottom stabilizing plate on each support member be exactly the same as the distance between those similar components in an integral support system having a plurality of separate, spaced support members. This permits the feature of each of the support members being independently adjustable to take into account the desired distance or adjustment required in order to provide a level horizontal support for the foundation of a building structure.

FIG. 3 illustrates in greater detail the construction and interaction between the various elements. In FIG. 3, the support member 20 is adapted to be operatively coupled to an "I" beam 24 having a lower flange 26. In FIG. 3, the strut stabilizing rod gripping means includes a support gripper plate 130 which is adapted to supportably engage one of the support beams, such as the lower flange 26 of the "I" beam 24. The other edge of support gripper plate 130 is adapted to be in contact with a support gripper spacer 136. As illustrated in FIG. 3, the support gripper plate 130 can be formed into an L-shaped or angle iron-type of arrangement. In the alternative, the support gripper plate could be a flat plate utilizing the bottom portion 130 only. The lower portion of the support gripper plate has two apertures 132 which are adapted to permit the passage of fasteners therethrough in order to develop a clamping force between the support gripper plate 130 and the support gripper spacer 136. The support gripper spacer 136 cooperates with the top stabilizing plate 58 to develop a clamping force which brings the edge of the support gripper plate 130 into tight frictional engagement with the support beam 24. In the alternative, if desired, the upper portion of the support gripper plate 130 could have a pluralitiy of apertures, shown as apertures 134, which permit connecting the support gripper plate 130 directly to the beam. Thus, the fasteners would be passed through aperture 132 of the support gripper plate 130, through the support gripper spacer 136 which is adapted to engage the surface of the support gripper plate 130 adjacent the support beam 24, and through apertures formed in the top stabilizing plate 58. In applications where apertures formed in the "I" beam are undesirable or not required, apertures 134 in gripper plate 130 can be eliminated.

FIG. 4 illustrates in greater detail the structural arrangement for utilizing a strut stabilizing rod gripping means, shown generally as 100, in an integral support system application. In FIG. 4, the "I" beam 24 has its lower flange 26 adapted to be positioned against a strut stabilizing gripper plate 202 having apertures 210. The strut stabilizing gripper plate 202 functions as the equivalent to a top stabilizing plate 58. A strut stabilizing clamping plate 208 is provided to engage the "I" beam 24. The strut stabilizing clamping plate 208 has apertures 212 formed therein. A pair of strut stabilizing gripper spacers 206 are utilized having apertures 216. The strut stabilizing gripper spacers 206 have a geometrical dimension in terms of width, length and thickness so as to fill in the space between the edge of the lower flange 26 and the edge of the strut stabilizing gripper plate 202. The thickness of the strut stabilizing gripper spacer 206 is such that a clamping force can be developed between the lower flange 26 and the strut stabilizing gripper plate 202 such that the edge of the strut stabilizing gripper plate 202 is brought into tight frictional engagement with the flange 26 of the support beam 24. The clamping means is developed by means of stress bolts 220 which are passed through the apertures 212 of the strut stabilizing clamping plate 208, through apertures 216 in the strut stabilizing gripper spacer 206 and through the apertures 210 in the strut stabilizing gripper plate 202. The stress bolts 220 are adapted to cooperate with a washer and a nut assembly 244. A tab 216 attached to the strut stabilizing gripper plate 202 is provided for connection to the end of a strut stabilizing rod.

FIG. 5 illustrates planar base 34 supporting a vertically extending support member 162 having threads 164 formed on its outer periphery. The vertically extending support member 162 is located along the axis of the vertically extending portion 38 which is in the form of a thin-walled cylinder. As shown in FIG. 5, tabs 46 and 108 are attached to the outer wall of the vertically extending portion 38.

An elongated thrust member 178 having a pair of protruding members 174 extending from one end thereof is located in the cavity within the vertically extending portion 38. The elongated thrust member 178 has an opening extending through the center thereof which is threaded with threads 172, which are adapted to coact with the threads 164 on the vertically extending support member 162.

The protruding tabs 174 are positioned toward the elongated sleeve member 50. The elongated sleeve member 50 has formed in the edge thereof, continguous the elongated thrust member 170, a pair of slots 178 which are adapted to receive the protruding tabs 174. Rotation of the elongated sleeve member 50 causes the slots 178 to drive the protruding tabs 174, causing relative movement between the elongated thrust member 170 and the vertically extending support member 162 to adjust the distance between the elongated thrust member 170 and planar base 34. A set screw 190 is provided which passes through a threaded opening 188 in the vertically extending portion 38 to engage and hold the elongated thrust member 170 in the desired position FIG. 6 illustrates an alternate embodiment wherein the "I" beam 24 is drilled so that fasteners 248 can pass through the "I" beam and gripping means and cooperate with a washer, nut assembly 250 to clamp the upper portion of the support gripper plate 130 against the beam web 24. As illustrated in FIG. 6, after the assembly has been completed, a set screw 252 can be utilized to lock the entire assembly in place. FIG. 6 further illustrates the method by which the fastening means 248 and the lock, washer, bolt assembly 250 cooperate with the support gripper plate 130 and the top stabilizing plate 58 such that when the fastener and nut are tightened, the clamping force is developed to urge the one edge of the support gripper plate 130 into tight frictional engagement with the beam and the edge of the support gripper plate 130 and the spacer 136 into tight frictional engagement with the rod stabilizing plate.

FIGS. 3 and 7 illustrate in greater detail the internal geometrical dimensions in the relationship between the various elements in order to provide for the adjustable height capability of the support member 20. The support member 20 is adapted to provide a support for the "I" beam 24 by the strut stabilizing rod connecting means 100 as described hereinbefore in connection with FIG. 4. In FIGS. 3 and 7, the support gripper clamping plate 130 does not have apertures formed in the vertically extending portion thereof which is adapted to be brought into engagement with the "I" beam 24. The support gripper plate 130 and the support gripper spacer 136 cooperate with the top stabilizing plate 58 to develop the tight frictional clamping force as described hereinbefore. The top member 54 has a top stabilizing plate 58 affixed thereto, and the lower extending portion 56 thereof is formed of an internal geometrical dimension and shape to receive and slide over the end 262 of sleeve 50. The rim of end 262 of sleeve 50 slides within the extended lower portion 56 of the top member 52 and into engagement with the top stabilizing plate 58. The position of the end 262 in engagement with the top stabilizing plate 58 is illustrated in FIG. 6. As stated hereinbefore, the top member 54 includes a support gripping means which is adapted to be affixedly attached to the top stabilizing plate 58 and to one of the beams, such as "I" beam 24. The top stabilizing plate 58 has at least one pair of aligned top tabs, of which 68 is typical of one pair and tab 66 is typical of the other pair, positioned one on each side of the lower extended portion of the top member 54.

The elongated sleeve member 50 has an elongated central opening extending therethrough forming rims at each of the ends 262 and 264. End 264 includes means for defining driving means engaging means, such as a pair of slots 178 which are adapted to coact with the driving means, such as a pair of protruding members 174, from the elongated thrust member 170. The internal dimension of the central opening in the elongated sleeve member 50 has a geometrical dimension which is substantially equal to the predetermined selected external dimension of the vertically extending support member 162. The external geometrical dimension, shape and dimension of the vertically extending support member 162 are such so as to permit the one end 264 of the sleeve member 50, which is the end having the pair of slots 178, to be inserted into and transported through the vertically extending portion 38 of the bottom member 36. The rim of end 264 having the slots 178 is brought into engagement with the rim of the elongated thrust member 170 having the protruding members 174 and wherein the slots 178 receive the protruding members 174. Thus, rotation of the elongated sleeve member 50, that is application of a rotational force around the longitudinal axis of the sleeve member, causes rotation of the thrust member 170 which enables the threaded members to cooperate to adjust the height of the entire support assembly by controlling the height between the top stabilizing plate 58 and the bottom stabilizing plate 38.

The vertically extending portion 38 of the bottom member 36 is formed of an internal geometrical dimension and shape to receive and slide over the elongated thrust member 170 which, in turn, is threadably mounted upon the vertically extending support member 162. As illustrated in FIGS. 3, 4 and 7, in the preferred embodiment, the exterior surface of the vertically extending portion 162 and the interal surface of the elongated thrust member 170 are threaded. However, any other type of means for causing relative motion therebetween, such as a slot-and-pin arrangement, is envisioned as a means for producing relative movement between the elongated thrust member 170 and the vertically extending support member 162.

As illustrated in FIGS. 3, 4 and 7, the elongated thrust member 170 has a selected axial length and a selected external geometrical dimension. The elongated thrust member 170 includes means for defining a hollowed-out central area which extends axially therethrough, forming a rim of a selected thickness at each end thereof. The hollowed-out central area defining means includes means for forming an interior wall having a second coacting means, which in the preferred embodiment is threaded, which is responsive to a rotational force applied between the sleeve 50 and the vertically extending support member 162 to produce relative movement therebetween. The hollowed-out area of the elongated thrust member 170 has a cross-sectional dimension and shape which is adapted to receive and pass the vertically extending support member 162. The elongated thrust member 170 further includes means for defining at least two protruding members 174 extending from the upper rim thereof, and each of the protruding members 174 are positioned on the rim of the elongated thrust member 170 so as to be in axial alignment with the hollowed-out central area. The elongated thrust member 170 is positioned on the vertically extending support member 162 such that the rim of the elongated thrust member 170 has the axially extending protruding members positioned remote from the planar base support plate 38 such that the first coacting means 164 on the vertically extending support member 162 and the second coacting means 172 formed on the internal surface of thrust member 170 coact with each other and are responsive to a rotational force applied therebetween to vary the distance between the elongated thrust member 170 and the planar base 34.

The slots 178 and protruding members 174 illustrated in FIGS. 3, 4 and 7 are one example of a driving means for performing the engagement and driving arrangement between these elements. If desired, the slots 178 at the end of the elongated sleeve member 50 could be formed into protruding members, and the protruding members 174 on the elongated thrust member 170 can be reversed and be formed into slots. Thus, any means of drivingly coupling the end 264 or the sleeve member 50 with the rim or end of the elongated slot member 170 such that rotation of the sleeve member 50 causes rotation of the elongated thrust member 170 and causes relative motion between thrust member 170 and the planar base 38 can be used. All such variations are intended to be utilizing the teachings of the present invention.

FIG. 8 illustrates an embodiment which is adapted to utilize the support member 20 as a support beam for a permanent building structure, such as a prefabricated home or an existing home or building. In FIG. 8, the top stabilizing plate 58 has a U-shaped member 300 formed thereon having a width which is adapted to receive a single solid beam 302. The U-shaped member is adapted to have apertures formed therein and an aperture is likewise formed through the center beam 302. An elongated fastener 304, which is passed through the apertures in the U-shaped member and beam, is fastened by a nut 306 to form a joined structure.

FIG. 9 illustrates an alternate embodiment wherein the top stabilizing plate 58 has spaced, opposed vertically extending side members 312 welded at line 316 to the top stabilizing plate 58. The embodiment of FIG. 9 is adapted to receive either a double beam or a laminated beam which forms a foundation for a building structure. In FIG. 9, the foundation has a support comprising elements 320 and 322 which form a beam. The vertically extending side members 312 have an aperture formed therein, and an aperture is likewise formed through beams 320 and 322. A bolt 324 is passed through the apertures in side walls 312 and elements 320 and 322, and the fastener has a nut 326 affixed thereto.

FIG. 10 illustrates an alternate arrangement for forming a support gripper means adapted to be utilized with an "I" beam arrangement. The support gripper plate 258 is illustrated as having a vertically extending member, without any apertures, which is adapted to engage the web of "I" beam 24. Rather than utilizing a support gripper plate, a welded bead line or narrow spacer 350 is provided along the external periphery of the top stabilizing plate 58. The thickness of the welded bead line 350 is slightly less than the thickness of the edge of the flange 26 of the "I" beam to permit a tight frictional clamping force to be developed to hold the "I" beam in place.

Figure 13:
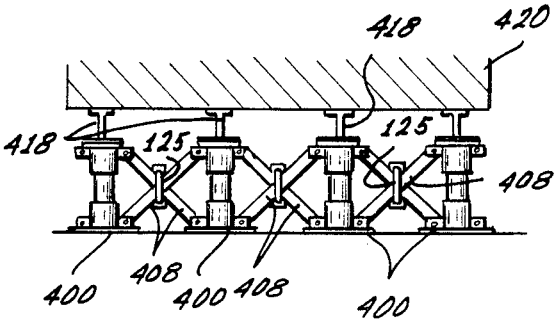
FIG. 13 is a front plan pictorial representation of the arrangement of the plurality of support members and plurality of strut stabilizing rods along the width of the mobile home illustrated in FIG. 11.
Figure 12:
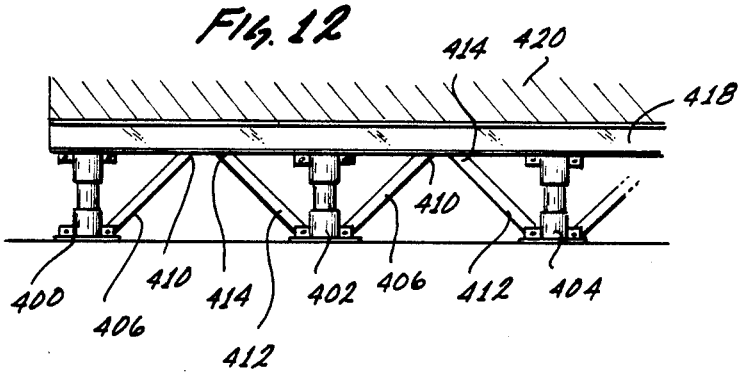
FIG. 12 is a partial, side view illustrating the relationship between a plurality of support members, a plurality of strut stabilizing rods, and a plurality of strut gripping means and the placement thereof along the length of the mobile home illustrated in FIG. 11.
Figure 11:
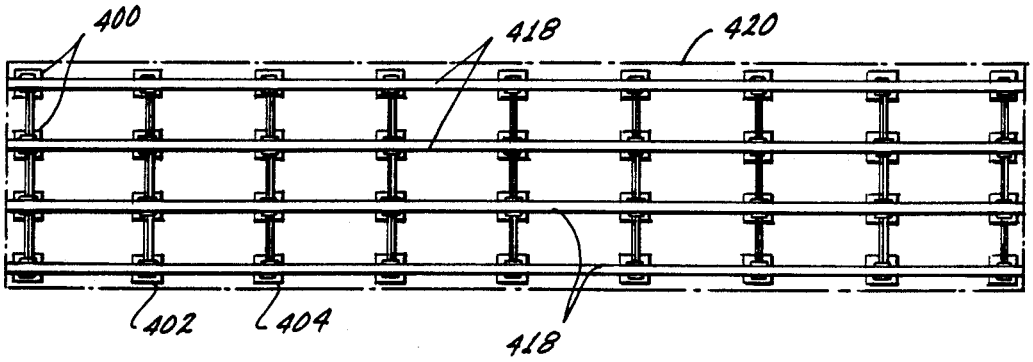
FIG. 11 is a top pictorial representation of the placement and location of a plurality of support members of a support system for supporting a mobile home having a width of approximately 16 feet and a length of approximately 80 feet.

FIG. 11 illustrates that the building structure, such as building structure 420 illustrated in FIGS. 12 and 13, is supported by a plurality of spoked "I" beams 418. The embodiment of FIG. 11 is a typical arrangement for a mobile home having a width of approximately 16 feet and a length of 80 feet. Thus, the "I" beams 418 are deemed to comprise a plurality of spaced, parallel support beams which function as a foundation for a building structure. In the embodiment of FIG. 11, four support members 400 would be located along the width thereof and eight support members would be located along the length thereof.

FIG. 12 illustrates the method of utilizing a plurality of support members 20 in an integral support system for a mobile home or other building structure. The support members 400, 402 and 404 are typically spaced along the length thereof at spacings of around 8 to 10 feet. Strut stabilizing rods 406 and 412 extend from the bottom base tabs of adjacent support members 400, 402 and 409 and extend to strut stabilizing gripper means 410 and 414, respectively, located on "I" beam 418.

FIG. 13 illustrates a typical arrangement of a plurality of support members 400 spaced along the width of a mobile home or a building structure to be supported by the integral support system of the present invention. The beams 418 support the building structure 420. The front support members 400, four of which are illustrated in FIG. 3, provide the support along the width thereof. Typically, the distance between support members would be in the order of 5 feet to 10 feet, depending on the width of the structure. As illustrated in FIG. 13, a pair of strut stabilizing rods 408 are utilized between each of the support members 400 and is interconnected to form an X-shaped frame member therebetween to provide rigid support. Thus, each strut stabilizing rod 408 extends between a lower base tab on one support member to the upper base tab on an adjacent support member to provide the desired support.

Figure 14:
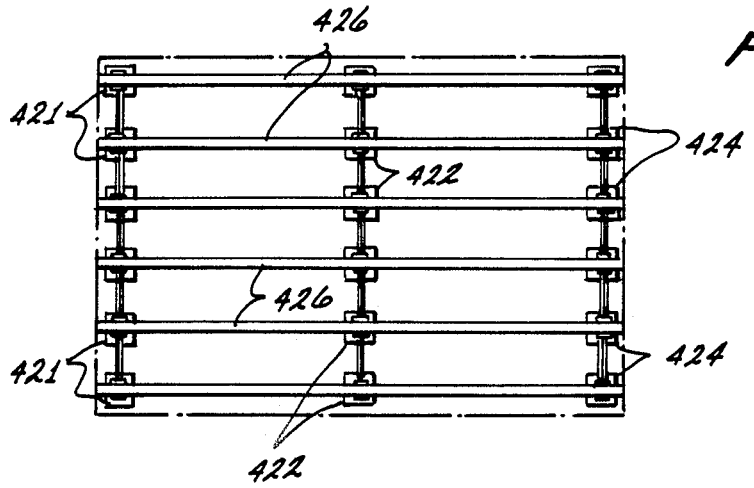
FIG. 14 is a top plan view illustrating the placement of the support members defining a support system for a double-wide mobile home having a width of approximately 24 to 28 feet and a length of approximately 40 feet.

FIG. 14 illustrates an arrangement for utilizing the support member in a system for supporting a double-wide mobile home which has a width of approximately 24 to 28 feet and a length of approximately 40 feet. In this arrangement, six support members 426 are utilized along the width thereof, and three rows of support members comprising supports 421, 422 and 424 provide the support for the mobile home.

Figure 15:
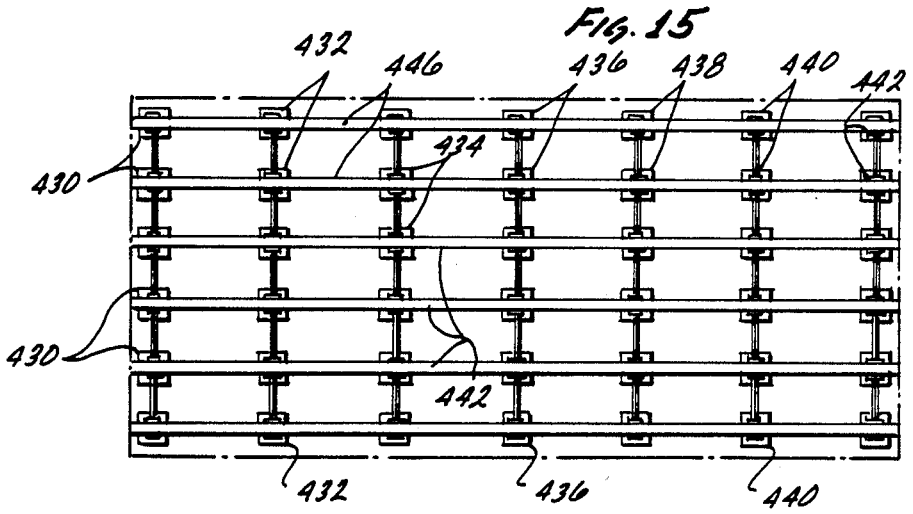
FIG. 15 is a top plan view illustrating the placement of the support members of the support system for a double-wide mobile home having a width of approximately 24 to 28 feet in one direction and an overall length of approximately 60 feet.

In FIG. 15, the mobile home having a width of approximately 24 to 28 feet and an overall length of approximately 60 feet would utilize six support members along the width thereof, indicated by the row 430 support members, and seven rows of support members, illustrated as rows 430, 432, 434, 436, 438, 440 and 442. The beams 446 would extend lengthwise on the mobile home.

Figure 16:
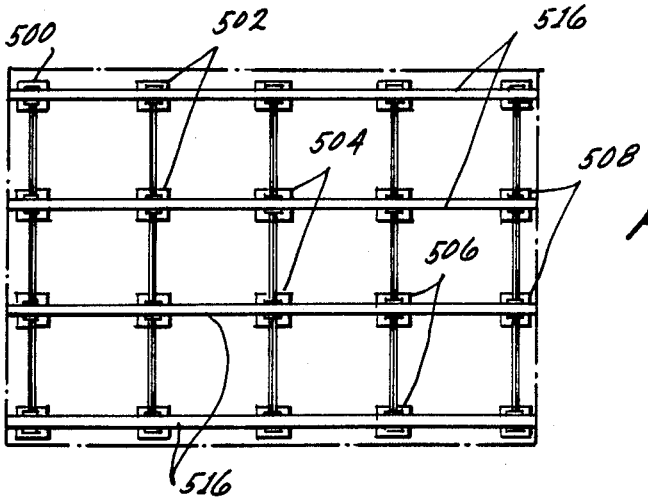
FIG. 16 is a top plan view of the support members utilized in a support system adapted to be utilized as a foundation under a manufactured home or a building structure having wooden beams or "I" beams or "J" beams placed thereunder to provide a foundation for the building structure wherein the house would have a dimension of approximately 28 feet in width and approximately 40 feet in length.

FIG. 16 illustrates an arrangement of support members for an integral support system which is adapted for use with a foundation under a manufactured home or building structure having wooden beams, "I" beams, or "J" beams or a combination thereof. If wooden beams are utilized as the foundation, the support members having the supports illustrated in FIGS. 8 and 9 could be utilized. If the support beams are formed of "I" beams or "J" beams, the gripping means illustrated in FIGS. 3, 5, 6, 7 and 10 could be used. In the system illustrated in FIG. 16, the building structure or house is illustrated to have a width of approximately 28 feet and a length of 40 feet. In such an arrangement, it is typical to utilize a foundation formed of a plurality of spaced, parallel support beams 516 which require four support members, illustrated as 500, along the width thereof, and five rows of support members illustrated by rows 500, 502, 504, 506 and 508 along the length thereof.

In FIGS. 14, 15 and 16, the strut stabilizing rod arrangement would be utilized across the width thereof in a manner similar to that illustrated in FIG. 13, and the strut supporting rod arrangement utilized along the length thereof would be in the arrangement illustrated in FIG. 12. If an "I" beam or a "J" beam is used, a support gripping means may be utilized with appropriate strut stabilizing gripping means to secure the strut stabilizing gripping means to the beam. If a wooden beam is used, the strut stabilizing gripping means would require use of a U-shaped support or its equivalent to support the ends of the strut stabilizing rods.

FIG. 17 illustrates an alternate embodiment wherein the support member is placed upon a concrete footing. The support member is identified by the same numerals utilized to identify the support member components in FIG. 1. The planar base 34 is adapted to have a plurality of holes formed therein which are adapted to receive J-bolts, which are embedded within the concrete support 600. The ends of the J-bolts 602 pass through the apertures in planar base 34, and the entire support member 20 is affixed to the foundation 600 by means of bolts 604.

FIG. 18 illustrates in greater detail the strut stabilizing means which is illustrated generally in FIG. 2. The top stabilizing plate 58 has a tab 106 extending therefrom. The lower extended portion 56, which extends from the top stabilizing plate 58, receives the elongated sleeve member 50, as illustrated in FIG. 2. The tab 106 is operatively coupled to a turnbuckle member 606, which has an elongated threaded member 608 rigidly affixed thereto. The elongated threaded member 608 is adapted to coact with a threaded nut 612 which is rigidly affixed to the U-shaped channel 122. In use, the opposite end of the strut stabilizing rod 122 would be affixed to its appropriate extended tab and the top turnbuckle member 606 would be rotated, causing the threaded member 606 to move relative to the nut 612 to adjust the length of the strut stabilizing rod to that length required to attach the top turnbuckle 606 to tab 106 by means of a bolt 616.

FIG. 19(*a*) illustrates the method for clamping the strut stabilizing rods 112 and 114 at the point where they intersect, as illustrated in FIG. 2. Specifically, a U-shaped bolt having sufficient dimension to receive therein both strut stabilizing rods 112 and 114.

FIG. 19(*b*) illustrates, in cross section, that the length of the U-bolt 124 is sufficient to enclose both the strut stabilizing rods 112 and 114 and extend a selected distance beyond the end of strut stabilizing rod 112 so as to pass through the apertures in a holding plate 620 and wherein the holding plate is clamped against the edge of strut stabilizing rod 112 by means of nut 622. The U-shaped clamping member 125 functions to increase the ridigity and support of the entire support system and ensures that the two coplanar strut stabilizing rods provide maximum support between the support members.

The fasteners or stress bolts utilized in the structure should be high-stress bolts and nuts and should be able to withstand a torque of 300 to 400 foot pounds. Typically, the frictional losses which would develop between the frictional clamping means and an "I" beam for all gripping means are about 13,500 pounds to about 16,000 pounds. In the preferred embodiments illustrated herein, the stress bolts and nut assemblies should be capable of withstanding a torque of at least 300 foot pounds in order to obtain the desired amount of frictional gripping between the gripping means and the "I" beam. Also, in the preferred embodiment, the vertical load placed on a support member can be in the order of about 120,000 pounds, with an ultimate maximum load of about 136,000.

The support system for a structure, mobile home, manufactured home, modular construction, or standard-type construction home using the teachings of the present invention has several important advantages and utilities. When the support system for such a structure or foundation is subjected to seismic waves generated during an earthquake, the entire supported assembly can be subjected to a rolling wave of various amplitudes and frequencies. Such a frequency is usually in the order of 10 cycles or less. The seismic waves cause one end or one side of the supported structure and the integral support system, utilizing the support members disclosed herein, to be raised or lowered relative to the other portion. In such event, a support system and the entire structure supported thereby form an integral unit such that any relative movement will occur only between the earth 72 and the planar base 38, as shown in FIG. 1.

Thus, the large gripping forces which are provided by the various gripping plates and associate components provide sufficient frictional clamping to hold the support structure to an "I" beam during a typical earthquake. Further, the large vertical load forces which support assembly 20 can far exceed any vertical loading which would be created between the support member assembly 20 and an "I" beam 24, and any vertical forces that would result in the entire structure and support system moving together relative to the seismic wave.

When the support member 20 is subjected to a seismic wave, additional stresses occur between each of the individual support assemblies along the end of the structure. In such event, the strut stabilizing rods serve to hold the entire support system together as an integral support system. Likewise, along the side of the structure, the strut stabilizing rod and support gripping means cooperate with the support members 20 to hold the support member assembly in a vertical, rigid relationship relative to the "I" beam or other beam forming the foundation of the structure such that the entire support system and structure will respond to forces generated by a seismic wave to move relative to the undulating ground. Further, in the event of relative movement between the ground, the structure, the integral support system formed of the support members 20, the strut stabilizing rods and strut stabilizing rod gripping means, the foundation or support beams of the structure are continually supported at all times such that one end thereof does not lose vertical support during the crucial time and that any relative movement between the structure and ground is limited solely to relative movement between the planar base 38 and the ground 72. After the structure with the integral support system is subjected to such a seismic wave, it is a relatively easy procedure to readjust the support members 20 by rotating the sleeve member 50 relative to the base 38 such that the structure can be relocated in a relatively horizontal or level position, or be placed back on its foundation, with very little damage.

One other utility of the integral support system is that all corners of the structure and the center thereof are continually supported by uniform support of predetermined height such that the relative movement which occurs between the ground and the support system may shift the foundation off its permanent location such that one or more support member's total height is not sufficient to enable support or contact with the ground. In such event, the remaining support members 20 afford sufficient support to ensure that the entire foundation of the structure is supported and not permitted to move a substantial distance relative to the supported portions thereof.

In installing the integral support system of the present invention under a building structure, each individual support member can have its height adjusted to an appropriate level such that the foundation is relatively level in a horizontal direction and the top stabilizing plates of each support member lie essentially in a coplanar relationship with each other. Thus, prior to such a unit experiencing any seismic activity, the foundation is supported at the corners and center thereof and in a substantially coplanar relationship with a plurality of support points. After such a foundation experiences a seismic wave, it is relatively easy to readjust the heights of the support members 20 to bring the foundation back into a substantial horizontal relationship, if any such change is experienced during the seismic wave, such that all support points are still subject to support.

What is claimed is:

1. A support member adapted for use in a support system for a building structure having a foundation formed of a plurality of spaced, parallel support beams wherein said support member is adapted to be positioned under one of a said beam, said support member comprising a planar base having a vertically extending support member of a selected length and a predetermined external dimension and shape, said vertically extending support member including first coacting means located around the periphery thereof;

an elongated thrust member having a selected axial length and a selected external geometrical dimension, said elongated thrust member including means for defining a hollowed-out central area which extends axially therethrough forming a rim of a selected thickness at each end thereof, said hollowed-out central area defining means including means for forming an interior wall having a second coacting means located thereon which is capable of coacting with said first coacting means in response to a rotational force applied around the longitudinal axis thereof to produce relative movement therebetween, said hollowed-out area having a cross-sectional dimension and shape which is adapted to receive and pass said vertically extending support member, said elongated thrust member further including means for defining a driving means on the edge of one of said rims and in axial alignment with the hollowed-out central area, said elongated thrust member being positioned on said vertically extending support member with the rim of the elongated thrust member having the axially extending protruding members positioned remote from said planar base such that said first coacting means and said second coacting means coact with each other and are responsive to a rotational force applied therebetween to vary the distance between said elongated thrust member and said planar base;

a bottom member having a vertically extending portion formed of an internal geometrical dimension and shaped to receive and slide over said elongated thrust member mounted on said vertically extending support member, said bottom member including at least one pair of aligned base tabs positioned adjacent the planar base and one on each side of the vertically extending portion positioned adjacent the planar base;

an elongated sleeve member having an elongated central opening extending therethrough forming rims at each end thereof, one of which includes means defining a driving means engaging means adapted to receive said driving means and wherein the internal geometrical dimension thereof is substantially equal to the predetermined selected external dimension of said vertically extending support member and the external geometrical dimension thereof is of a shape and dimension to permit said one end of the sleeve member having said driving means engaging means inserted into and transported through said vertically extending portion of the bottom member wherein the rim thereof is brought into engagement with the rim of said elongated thrust member and said slot receives said protruding member;

a top member having a top stabilizing plate and an extended lower portion formed of an internal geometrical dimension and shape to receive and slide over the other end of said sleeve member permitting the other rim to slide within said extended lower portion of said top member into engagement with said top stabilizing plate, said top member including a gripping means adapted to be fixedly attached to said top stabilizing plate and to one of said beams, said top stabilizing plate having at least one pair of aligned top tabs positioned one on each side of the lower extended portion of the top member and positioned in spaced parallel alignment with said at least one pair of base tabs;

at least two strut stabilizing rods each having one end extending from at least one of a selected one of the top tabs and a selected one of the bottom tabs; and means for fixedly connecting said one of said strut stabilizing rods to at least one of said selected tabs and a selected bottom tab.

2. The support member of claim 1 wherein said first and second coacting means are threaded members.

3. The support member of claim 2 wherein said gripping means comprises a U-shaped member adapted to receive and support a said beam.

4. The support member of claim 1 wherein said driving means are a pair of protruding members and said driving means engaging means is a pair of slots adapted to receive and drive said pair of protruding members.

5. A support system for a building structure having a foundation formed of a plurality of spaced, parallel support beams comprising at least one support member adapted to be positioned under one of a said beam including a planar base having a vertically extending support member of a selected length and a predetermined external dimension and shape, said vertically extending support member including first coacting means located around the periphery thereof;

an elongated thrust member having a selected axial length and a selected external geometrical dimension, said elongated thrust member including means for defining a hollowed-out central area which extends axially therethrough forming a rim of a selected thickness at each end thereof, said hollowed-out central area defining means including means for forming an interior wall having a second coacting means located thereon which is capable of coacting with said first coacting means in response to a rotational force applied therebetween to produce relative movement therebetween, said hollowed-out area having a cross-sectional dimension and shape which is adapted to receive and pass said vertically extending support member, said elongated thrust member further including means for defining at least two protruding members extending from one of said rims and in axial alignment with the hollowed-out central area, said elongated thrust member being positioned on said vertically extending support member with the rim thereof having the axially extending protruding member positioned remote from said elongated support member such that said first coacting means and said second coacting means coact with each other and are responsive to a rotational force applied therebetween to vary the distance between said elongated thrust member and said planar base;

a bottom member having a vertically extending portion formed of an internal geometrical dimension and shaped to receive and slide over said elongated thrust member mounted on said vertically extending support member, said bottom member including at least one pair of aligned base tabs positioned adjacent the planar base and one on each side of the vertically extending portion positioned adjacent the planar base;

an elongated sleeve member having an elongated central opening extending therethrough forming rims at each end thereof, one of which includes means defining a pair of slots adapted to receive and drive said protruding members and wherein the internal geometrical dimension thereof is substantially equal to the predetermined selected external dimension of said vertically extending support member and the external geometrical dimension thereof is of a shape and dimension to permit said one end of the sleeve member having said slot inserted into and transported through said vertically extending portion of the bottom member wherein the rim thereof is brought into engagement with the rim of said elongated thrust member and said slots receive said protruding members;

a top member having a top stabilizing plate and an extended lower portion formed of an internal geometrical dimension and shape to receive and slide over the other end of said sleeve member permitting the other rim to slide within said extended lower portion of said top member into engagement with said top stabilizing plate, said top member including a gripping means adapted to be fixedly attached to said top stabilizing plate and to one of said beams, said top stabilizing plate having at least one pair of aligned top tabs positioned one on each side of the lower extended portion of the top and positioned in spaced parallel alignment with said at least one pair of base tabs;

at least two strut stabilizing rods, each having one end extending from at least one of a selected one of the top tabs and a selected one of the bottom tabs; and means for fixedly connecting said one of said stabilizing rods to at least of one of said selected tabs and a selected bottom tab.

6. The support system of claim 5 wherein said first coacting means and said second coacting means are threaded members.

7. The support system of claim 6 further comprising a strut stabilizing rod gripping member adapted to be attached to one of a said support beam and comprising a strut stabilizing plate;

a strut stabilizing gripper spacer positioned to engage the surface of said strut stabilizing plate adjacent one of a said support beam;

a strut stabilizing gripper plate adapted to supportably engage one of a said support beams and the other edge thereof in contact with said strut stabilizing gripper spacer; and means for providing a strut stabilizing clamping force between said strut stabilizing plate, said strut stabilizing gripper plate and said strut stabilizing gripper spacer urging said one edge of the strut stabilizing gripper plate into tight frictional engagement with one of a said support beam.

8. The support system of claim 7 wherein said strut stabilizing clamping force means is capable of producing an initial tight frictional clamping force between said one edge of the strut stabilizing gripper plate and a said bottom flange on one side of a support beam in the order of at least 16,000 pounds and a continuing frictional clamping force in the order of at least 13,500 pounds.

9. The support system of claim 8 wherein said strut stabilizing clamping means includes a stress bolt and a nut assembly capable of withstanding a torque of at least 300 foot pounds.

10. The support system of claim 5 wherein said fixedly connecting means comprises fastening means.

11. The support system of claim 10 wherein said fastening means comprises a stress bolt and a stress nut assembly capable of withstanding a torque of at 1east 300 foot pounds.

12. The support system of claim 5 wherein said top member gripping means comprises a support gripper spacer positioned to engage the surface of the top stabilizing plate adjacent a bottom flange on said one of said support beams;

a support gripper plate adapted to have one edge thereof engage a said bottom flange on said one of a said support beam and the other edge thereof in contact with said top gripper spacer; and means for providing a clamping force between said top stabilizing plate, said support gripper plate and said support gripper spacer urging said one edge of the support gripper plate into tight frictional engagement with a said bottom flange on said one of said support beams.

13. The support system of claim 12 wherein said clamping force means is capable of producing an initial tight frictional clamping force between said one edge of the top gripper plate and a said bottom flange on said one of a said support beam in the order of at least about 16,000 pounds and a continuing frinctional clamping force in the order of at least 13,500 pounds.

14. The support system of claim 13 wherein said clamping force means includes a stress bolt and a nut assembly capable of with standing a torque of at least 300 foot pounds.

15. The support system of claim 14 wherein said at least one support member assembly is capable of withstanding a vertical load of about 120,000 pounds and an ultimate load of about 136,000 pounds.

16. An integral support system for a mobile home having a chassis formed of a plurality of spaced, parallel support means having an I-shaped cross section, which defines a bottom flange comprising a plurality of support members adapted to be positioned under said support beams, each of said support members including a planar base having a vertically extending support member of a selected length and a predetermined external dimension and shape, said vertically extending support member including first coacting means located around the periphery thereof;

an elongated thrust member having a selected axial length and a selected external geometrical dimension, said elongated thrust member including means for defining a hollowed-out central area which extends axially therethrough forming a rim of a selected thickness at each end thereof, said hollowed-out central area defining means including means for forming an interior wall having a second coacting means located thereon which is capable of coacting with said first coacting means in response to a rotational force applied therebetween to produce relative movement therebetween, said hollowed-out area having a cross-sectional dimension and shape which is adapted to receive and pass said vertically extending support member, said elongated thrust member further including means for defining at least two protruding members extending from one of said rims and in axial alignment with the hollowed-out central area, said elongated thrust member being positioned on said vertically extending support member with the rim thereof having the axially extending protruding member positioned remote from said elongated support member such that said first coacting means and said second coacting means coact with each other and are responsive to an axial rotational force applied therebetween to vary the distance between said elongated thrust member and said planar base;

a bottom member having a vertically extending portion formed of an internal geometrical dimension and shaped to receive and slide over said elongated thrust member mounted on said vertically extending support member, said bottom member including at least one pair of aligned base tabs positioned adjacent the planar base and one on each side of the vertically extending portion positioned adjacent the planar base;

an elongated sleeve member having an elongated central opening extending therethrough forming rims at each end thereof, one of which includes means defining two slots adapted to receive and drive said protruding members and wherein the internal geometrical dimension thereof is substantially equal to the predetermined selected external dimension of said vertically extending support member and the external geometrical dimension thereof is of a shape and dimension to permit said one end of the sleeve member having said slot inserted into and transported through said vertically extending portion of the bottom member wherein the rim thereof is brought into engagement with the rim of said elongated thrust member and said slots receive said protruding members;

a top member having a top stabilizing plate and an extended lower portion formed of an internal geometrical dimension and shape to receive and slide over the other end of said sleeve member permitting the other rim to slide within said extended lower portion of said top member into engagement with said top stabilizing plate, said top member including a gripping means adapted to be fixedly attached to said top stabilizing plate and to one of said beams, said top stabilizing plate having at least one pair of aligned top tabs positioned one on each side of the lower extended portion of the top and positioned in spaced parallel alignment with said at least one pair of base tabs;

at least two strut stabilizing rods each having one end extending from at least one of a selected one of the top tabs and a selected one of the bottom tabs;

means for fixedly connecting said one of said stabilizing rods to at least one of said selected top tab and a selected bottom tab; and a strut stabilizing rod gripping means adapted to be attached to a bottom flange on one of said support beams and comprising a strut stabilizing plate;

a strut stabilizing gripper spacer positioned to engage the surface of a said strut stabilizing plate adjacent a bottom flange on said one of a said support beam;

a strut stabilizing gripper plate adapted to have one edge thereof engage a bottom flange on said one of a said support beam and the other edge thereof in contact with said strut stabilizing gripper spacer; and means for providing a strut stabilizing clamping force between said strut stabilizing plate, said strut stabilizing gripper plate and said strut stabilizing gripper spacer urging said one edge of the strut stabilizing gripper plate into tight frictional engagement with a bottom flange on said one of a said support beam.

17. A support member adapted for use in a support system for a building structure having a foundation formed of a plurality of spaced, parallel support beams wherein said support member is adapted to be positioned under one of a said beam, said support member including a planar base., an elongated sleeve member, a bottom member, and a top member having gripping means affixed thereto characterized in that said planar base has a vertically extending support member of a selected length and a predetermined external dimension and shape, said vertically extending support member including first coacting means located around the periphery thereof;

an elongated thrust member having a selected axial length and a selected external geometrical dimension, said elongated thrust member including means for defining a hollowed-out central area which extends axially therethrough forming a rim of a selected thickness at each end thereof, said hollowed-out central area defining means including means for forming an interior wall having a second coacting means located thereon which is capable of coacting with said first coacting means in response to a rotational force applied therebetween to produce relative movement therebetween, said hollowed-out area having a cross-sectional dimension and shape which is adapted to receive and pass said vertically extending support member; and means operatively coupled to said elongated thrust member for applying a rotational force between said vertically extending support member and said elongated thrust member to produce relative movement therebetween which varies the distance between said elongated thrust member and said planar base.

18. The support member of claim 17 wherein said elongated thrust member includes a driving means located on the rim thereof which is remote from the planar base and wherein the elongated sleeve member includes driving means engaging means which are adapted to coact with the driving means engaging means in response to an axial rotational force to adjust the elongated thrust member relative to the planar base plate.

19. The support member of claim 17 wherein said first and second coacting means are threaded members.

20. The support member of claim 19 further comprising set screw means for holding the vertically extending support means in position relative to the elongated thrust member.

21. The support member of claim 17 further comprising at least two strut stabilizing rods each having one end extending from the bottom of one support member and extending to the top of a second adjacent support member and wherein each of the strut stabilizing rods are positioned to form an X-shaped support structure wherein the strut stabilizing rods are contiguous each other at the center of the X-shaped support; and a U-shaped clamping means adapted to enclose the two strut stabilizing rods at the center point of the X-support structure, said U-shaped clamping means including means cooperating with the U-shaped clamp for joining the two strut stabilizing rods together.

22. The support member of claim 21 further comprising a turnbuckle member having an aperture at one end thereof and an elongated member having a threaded periphery extending from the other end thereof; and coacting means affixed to one end of the strut stabilizing rod, said coacting means having an opening which is threaded to coact with the threading on the periphery of the elongated member extending from the turnbuckle, said elongated threaded member extending from said turnbuckle being adapted to coact with the coacting means affixed to one end of said strut stabilizing rod such that, when a rotational force is applied in a predetermined direction around the axis of the turnbuckle member, causing the turnbuckle member to move away from the end of the strut stabilizing rod member containing the coacting means and wherein said aperture located at the other end of said turnbuckle means is adapted to be attached to a top member of a support member.

23. The support member of claim 17 wherein said planar base has apertures formed therein and further comprising a concrete support member adapted to be positioned under the support member and in supporting relationship with the planar base, said concrete support member further including at least two J-shaped bolt members which are embedded within the concrete support member and which have a portion extending above the concrete support and through apertures formed in the planar base; and fastening means adapted to be operatively attached to the end of the J-shaped bolt members extending from the concrete support for rigidly attaching the support member to the J-shaped bolt members.

* * * * *